US009994991B2

(12) United States Patent
Sato et al.

(10) Patent No.: US 9,994,991 B2
(45) Date of Patent: Jun. 12, 2018

(54) WASHING MACHINE

(71) Applicants: HAIER ASIA INTERNATIONAL CO., LTD., Osaka (JP); QINGDAO HAIER WASHING MACHINE CO., LTD., Shandong (CN)

(72) Inventors: Hiroki Sato, Osaka (JP); Yukio Tobi, Osaka (JP); Hiroyuki Kitakawa, Osaka (JP); Yuka Yoshida, Osaka (JP); Noriyuki Mori, Osaka (JP)

(73) Assignees: Haier Asia International Co., Ltd., Osaka (JP); Qingdao Haier Washing Machine Co., Ltd, Shandong (CN)

( * ) Notice: Subject to any disclaimer, the term of this patent is extended or adjusted under 35 U.S.C. 154(b) by 21 days.

(21) Appl. No.: 15/112,129

(22) PCT Filed: Dec. 31, 2014

(86) PCT No.: PCT/CN2014/095937

§ 371 (c)(1),
(2) Date: Jul. 15, 2016

(87) PCT Pub. No.: WO2015/106631

PCT Pub. Date: Jul. 23, 2015

(65) Prior Publication Data

US 2016/0326682 A1 Nov. 10, 2016

(30) Foreign Application Priority Data

Jan. 20, 2014 (JP) ..... 2014-007678

(51) Int. Cl.
*D06F 39/00* (2006.01)
*D06F 33/02* (2006.01)

(52) U.S. Cl.
CPC ..... *D06F 39/005* (2013.01); *D06F 33/02* (2013.01); *D06F 2210/00* (2013.01)

(58) Field of Classification Search
CPC ..... D06F 39/005; D06F 33/02; D06F 2210/00
See application file for complete search history.

(56) References Cited

U.S. PATENT DOCUMENTS 6,924,469 B1 * 8/2005 Strong ..... H05B 6/6435 219/506
2008/0105001 A1 * 5/2008 Jeong ..... D06F 33/02 68/12.02

(Continued)

FOREIGN PATENT DOCUMENTS

CN 1465769 A 1/2004
CN 101168901 A 4/2008

(Continued)

OTHER PUBLICATIONS

International Search Report dated Apr. 3, 2015 from International Patent Application No. PCT/CN2014/095937 filed Dec. 31, 2014.

(Continued)

*Primary Examiner* — Michael Barr
*Assistant Examiner* — Benjamin L Osterhout
(74) *Attorney, Agent, or Firm* — Sunstone IP

(57) ABSTRACT

A full-automatic washing machine includes: a first control part, a receiving part, a body display part arranged on an upper panel, and a remote controller separated from the body display part. The remote controller includes: setting keys for setting operating information of a washing operation, a second control part, an information display part and a transmitting part. The second control part displays operating information set by the setting keys through the information display part, and transmits the operating information by the transmitting part to the receiving part through wireless communication. A mode display part of the body display part is illuminated in a color such as blue corresponding to the reception of the operating information until the washing (Continued)

operation starts when the first control part receives the operating information.

13 Claims, 19 Drawing Sheets

(56) References Cited

U.S. PATENT DOCUMENTS

2012/0021684 A1* 1/2012 Schultz ..... H04B 5/0043 455/41.1
2012/0024016 A1* 2/2012 Dunn ..... D06F 35/007 68/12.27
2012/0090360 A1* 4/2012 Nolan ..... D06F 23/04 68/12.19
2012/0111066 A1* 5/2012 Hayashi ..... D06F 35/003 68/19
2013/0005250 A1* 1/2013 Kim ..... H04N 21/4126 455/41.1
2013/0074117 A1* 3/2013 Song ..... H04W 4/06 725/31
2014/0067131 A1* 3/2014 Park ..... A47L 15/4293 700/275
2014/0148147 A1* 5/2014 Tak ..... H04M 1/72533 455/420
2014/0156081 A1* 6/2014 Ha ..... D06F 33/02 700/275
2014/0156082 A1* 6/2014 Ha ..... D06F 33/02 700/275
2014/0197934 A1* 7/2014 Ha ..... H04L 12/12 340/12.5
2015/0095790 A1* 4/2015 Yoshida ..... G06F 3/0482 715/740
2015/0299927 A1* 10/2015 Kim ..... D06F 31/00 68/27

FOREIGN PATENT DOCUMENTS

| | | | |
|---|---|---|---|
| CN | 203096431 | U | 7/2013 |
| DE | 29622066 | U1 | 4/1998 |
| EP | 0802465 | A2 | 10/1997 |
| EP | 1548174 | A1 | 6/2005 |
| GB | 2265158 | A | 9/1993 |
| JP | 5-154280 | | 6/1993 |
| JP | 06-105989 | A | 4/1994 |
| JP | 2000346355 | A | 12/2000 |
| JP | 2001129295 | A | 5/2001 |
| JP | 2002022357 | A | 1/2002 |
| JP | 2003210890 | A | 7/2003 |
| JP | 2009-226060 | A | 10/2009 |
| JP | 2014000187 | A | 1/2014 |
| KR | 20020020832 | | 3/2002 |
| KR | 10-2005-0123187 | | 12/2005 |
| KR | 20120118366 | A | 10/2012 |
| WO | 02/086210 | A1 | 10/2002 |

OTHER PUBLICATIONS

International Preliminary Report on Patentability dated Jul. 26, 2016 from International Patent Application No. PCT/CN2014/095937 filed Dec. 31, 2014.

* cited by examiner

| Operating process | Water quantity (l) | Washing (min) | Rinsing (times) | Dewatering (min) |
|---|---|---|---|---|
| Standard | Automatic | 10 | 2 | 7 |
| Self-shunting | Automatic | 10 | 2 | 7 |
| Quick washing | 32 | 5 | 1 | 3 |
| Drying | 40 | 5 | 2 | 3 |
| Blanket | 55 | 15 | 2 | 12 |
| Tank washing | 55 | 120 | 1 | 30 |

FIG.6

(a)

| | Operating information | | | | | | | | | | | | |
|---|---|---|---|---|---|---|---|---|---|---|---|---|---|
| Operating process | Standard | | Self-shunting | | Quick washing | | Drying | | Blanket | | Tank washing | | |
| Water quantity (l) | 15 | | 32 | | 41 | | 51 | | 55 | | Automatic | | |
| Washing (min) | 5 | | 6 | | 10 | | 15 | | None | | | | |
| Rinsing (times) | 1 | | 2 | | 3 | | None | | | | | | |
| Dewatering (min) | 0.5 | | 3 | | 7 | | 12 | | None | | | | |
| Air drying (hr) | 0.5 | | 1 | | 2 | | 3.5 | | None | | | | |
| Reserving (hr) | 1 | 2 | 3 | 4 | 5 | 6 | 7 | 8 | 9 | 10 | 11 | 12 | None |
| Bathwater water supply | Yes | | None | | | | | | | | | | |

(b)

| | Operating information |
|---|---|
| Operating process | Standard |
| Water quantity (l) | 55 |
| Washing (min) | 15 |
| Rinsing (times) | |
| Dewatering (min) | |
| Air drying (hr) | |
| Reserving (hr) | 8 |
| Bathwater water supply | Yes |

(c)

| | Operating information |
|---|---|
| Operating process | Standard |
| Water quantity (l) | Automatic |
| Washing (min) | 10 |
| Rinsing (times) | 2 |
| Dewatering (min) | 7 |
| Air drying (hr) | |
| Reserving (hr) | 8 |
| Bathwater water supply | Yes |

FIG.9

(a)
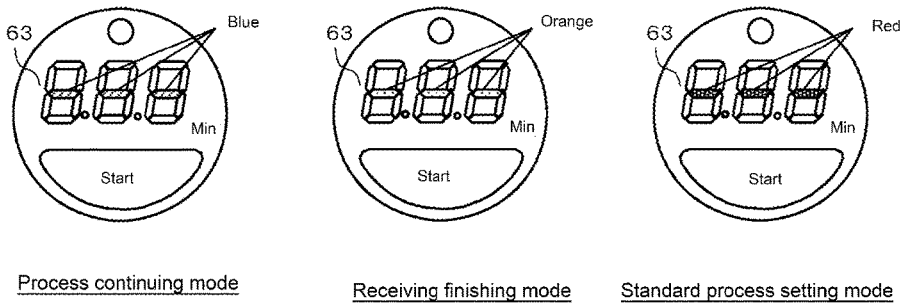
(b)
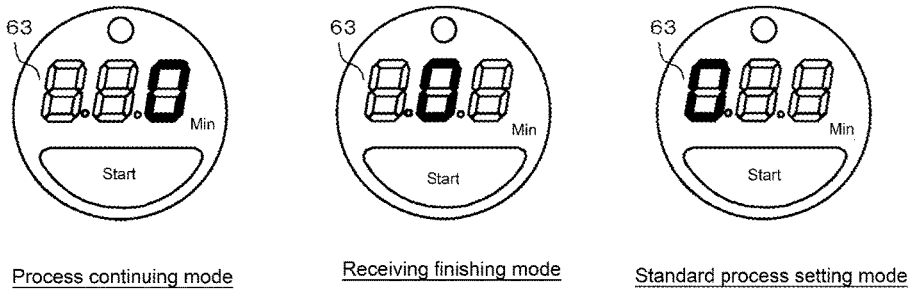
FIG.19

WASHING MACHINE

CROSS REFERENCE TO RELATED APPLICATION

This application is a National Stage of International Patent Application No. PCT/CN2014/095937 filed on Dec. 31, 2014, which claims the benefit of Japanese Patent Application No. 2014-007678 filed on Jan. 20, 2014, the disclosures of which are hereby incorporated entirely herein by reference.

TECHNICAL FIELD

The present disclosure relates to a washing machine.

BACKGROUND

In the past, a throwing port is formed on an upper surface of a housing of a washing machine, and an operating part is arranged to be adjacent to the throwing port. In the operating part, besides a power key and a starting key, a plurality of setting keys for setting operating information involving a washing operation, an information display part for displaying the set operating information, and the like are configured. Operating information involving the washing operation includes operating processes of a standard process, a self-shunting process, a quick washing process and the like, as well as operating conditions of washing time, number of rinsing times, dewatering time, etc.

As stated above, because the operating part has a plurality of keys and an information display part, a large region is occupied at the upper surface of the housing. Therefore, in an existing washing machine, it is difficult to arrange a throwing port large enough for an opening part of a washing tank.

Therefore, to diminish the operating part, in the washing machine, a structure can be adopted in such a manner that the setting keys and the information display part are at least configured on a remote controller separated from the operating part, and the remote controller transmits operating information to the operating part in a wireless mode (referring to patent document 1).

EXISTING TECHNICAL DOCUMENT

Patent Document

Patent document 1: JP Laid-Open 2009-226060

SUMMARY

Subject to be Solved by the Disclosure

As a communication mode performed in a wireless mode, a bidirectional communication mode and a unidirectional communication mode can be adopted. Under a condition of adopting the unidirectional communication mode, a structure for communication can be made into a simple structure. In addition, cost and power consumption can be reduced.

However, under a condition of adopting the unidirectional communication mode, transmission from an operating part of a body side to the remote controller is not performed. Therefore, when a user transmits operating information from the remote controller, the transmitted operating information is received by the operating part, so that, based on this, it is impossible to confirm on a remote controller side whether the operating part has performed update of operating information. Therefore, under a condition of not receiving a wireless signal, and when the transmitted operating information is not received by the operating part for a certain reason and a washing operation is started directly with previous operating information, a hidden danger that washing cannot be performed according to an intention of the user may exist.

The present disclosure is accomplished in view of such a problem and aims to provide a washing machine. Under a condition that the washing machine is constituted in a mode of setting operating information involved in a washing operation of operating processes, operating conditions and the like in a unidirectional wireless communication mode, a condition that a washing operation cannot be performed according to an intention of the user due to incomplete reception of the operating information can be prevented.

Solution for Solving Subject

The washing machine involved in a main embodiment of the present disclosure includes: a washing tank for performing washing of washings; a housing for accommodating the washing tank; a first display part arranged on a surface having a throwing port of the housing; a first control part; a receiving part; and a setting operating part separated from the first display part. Here, the setting operating part includes: setting keys for setting operating information involved in a washing operation; a second control part; a second display part; and a transmitting part. The second control part displays the operating information set by the setting keys through the second display part, and transmits the operating information by the transmitting part to the receiving part through wireless communication. The first control part executes a washing operation based on the operating information received by the receiving part, and the first display part is illuminated in a first form corresponding to the reception of the operating information at least within a specified period until washing the operation starts when the operating information is received by the receiving part.

According to the above structure, when the operating information set by the setting operating part is received by the receiving part, the first display part is illuminated in a first form corresponding to the reception of the operating information, e.g., a color corresponding to the reception at least within a specified period until the washing operation starts. Thus, the user can confirm that the receiving part has received the set operating information, and when the operating information is not received, the washing operation can be started on the basis of performing resetting of the operating information. Therefore, a washing operation not in accordance with an intention of the user can be prevented from being performed.

The washing machine of the present embodiment can adopt a structure in which a starting key for starting the washing operation is arranged on a surface having the throwing port. In addition, the operating information can include a plurality of operating processes having a standard process. In this case, when the first control part performs a specified operation on the starting key different from start of the washing operation, the standard process is set as an operating process which should be executed by replacing an operating process received by the receiving part prior to the operation.

According to the above structure, because not only the setting operating part, but also the starting key is configured to set with respect to the standard process with a highest use frequency, use convenience of the user can be optimized.

Under a condition of adopting the above structure, then, the first control part can adopt a structure that when the standard process is set as the operating process which should be executed based on the specified operation, the first display part is illuminated in a second form different from the first form.

As long as such structure is adopted, the user can confirm that the specified operation is accepted and operating processes are set in the standard process.

Then, in the washing machine of the present embodiment, the setting operating part can adopt a structure having a confirming key and an operating information storing part for storing the operating information. In this case, the second control part can adopt a structure that the operating information transmitted by the transmitting part is stored in the operating information storing part, and the operating information stored in the operating information storing part is read and the read operating information is displayed by the second display part when the confirming key is operated.

According to the above structure, the user can confirm that the operating information is set by the setting operating part by operating the confirming key.

Then, in the washing machine of the present embodiment, the setting operating part can adopt a remote controller. In this case, then, the washing machine of the present embodiment can adopt a structure that a magnet is arranged in the remote controller and a magnetic body forms at least a part of the housing.

According to the above structure, the user can easily install the remote controller in a body of the washing machine.

Then, the washing machine of the present embodiment can adopt a structure that the washing tank has an opening part on an upper surface, the throwing port is formed on the upper surface of the housing, at least a front opening of the throwing port is larger than the opening part, and the first display part is arranged on a corner of a front side on the upper surface of the housing.

According to the above structure, because at least a front of the throwing port is larger than the opening part of the washing tank, washings can be easily thrown into and withdrawn from the washing tank by the user from the front of the washing machine. Then, because the first display part is arranged on the corner having a large space on the upper surface of the housing, the first display part can be expanded.

Effects of the Disclosure

According to the present disclosure, under a condition that the washing machine adopts a structure of setting the operating information involved in a washing operation through unidirectional wireless communication, a condition that a washing operation not in accordance with an intention of the user due to incomplete reception of the operating information can be prevented from being performed.

Effects or significance of the present disclosure is further defined according to description of embodiments shown below. However, the embodiments below are only examples when the present disclosure is implemented, and the present disclosure is not limited by any of the embodiments below.

DESCRIPTION OF THE DRAWINGS

FIG. 6 is a diagram showing one example of operating conditions stored in an operating condition storing part involved in embodiments;

FIG. 9 is a diagram showing one example of operating information stored in a setting candidate storing part, a transmission information storing part and a latest information storing part involved in embodiments;

FIG. 19 is a diagram showing a condition of illuminating a remaining time part according to an operating mode involved in a changed example.

DETAILED DESCRIPTION

Description is made below to a full-automatic washing machine as one embodiment of a washing machine of the present disclosure with reference to drawings.

Figure 1:
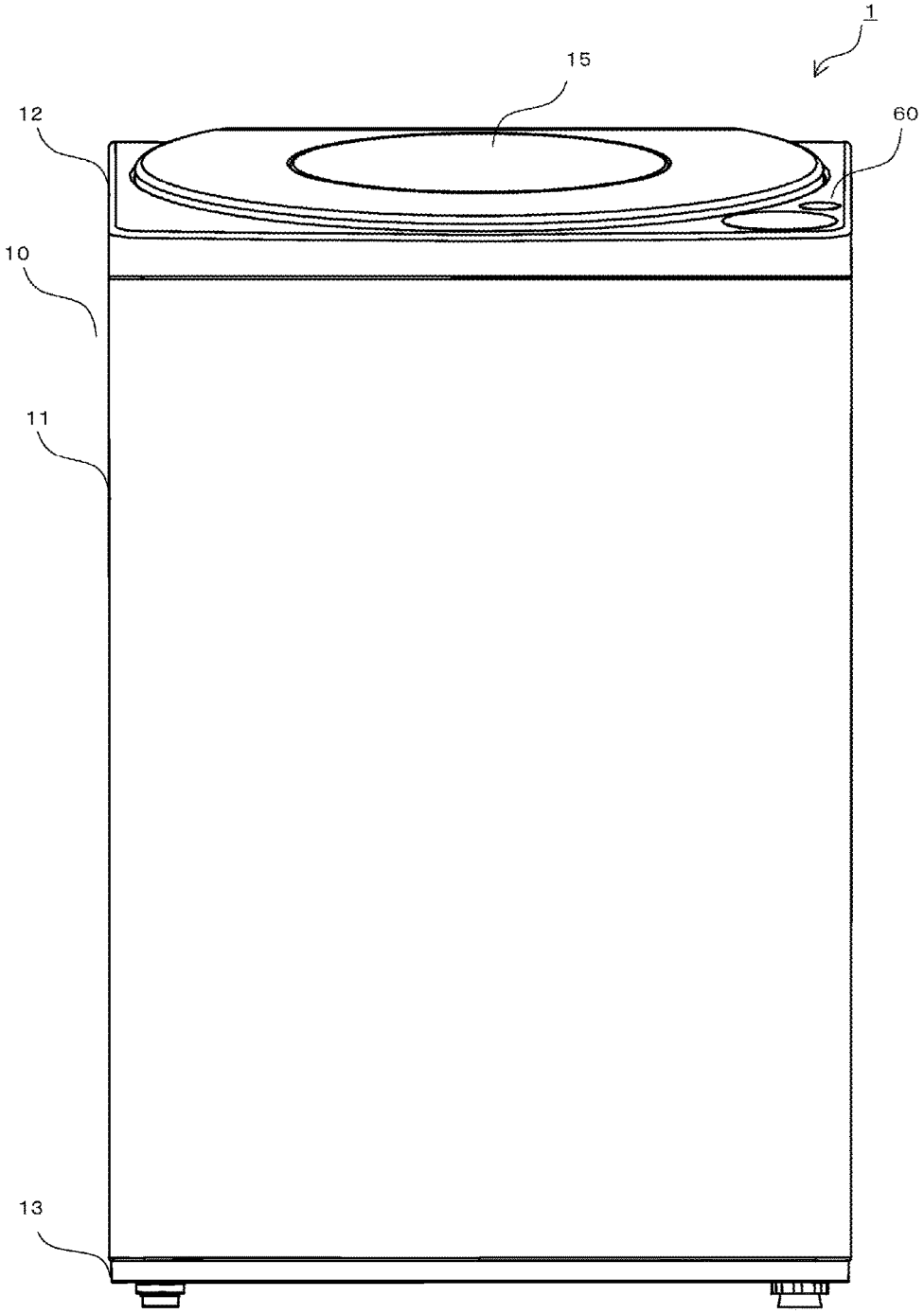
FIG. 1 is a main view showing an appearance of a full-automatic washing machine involved in embodiments.
Figure 2:
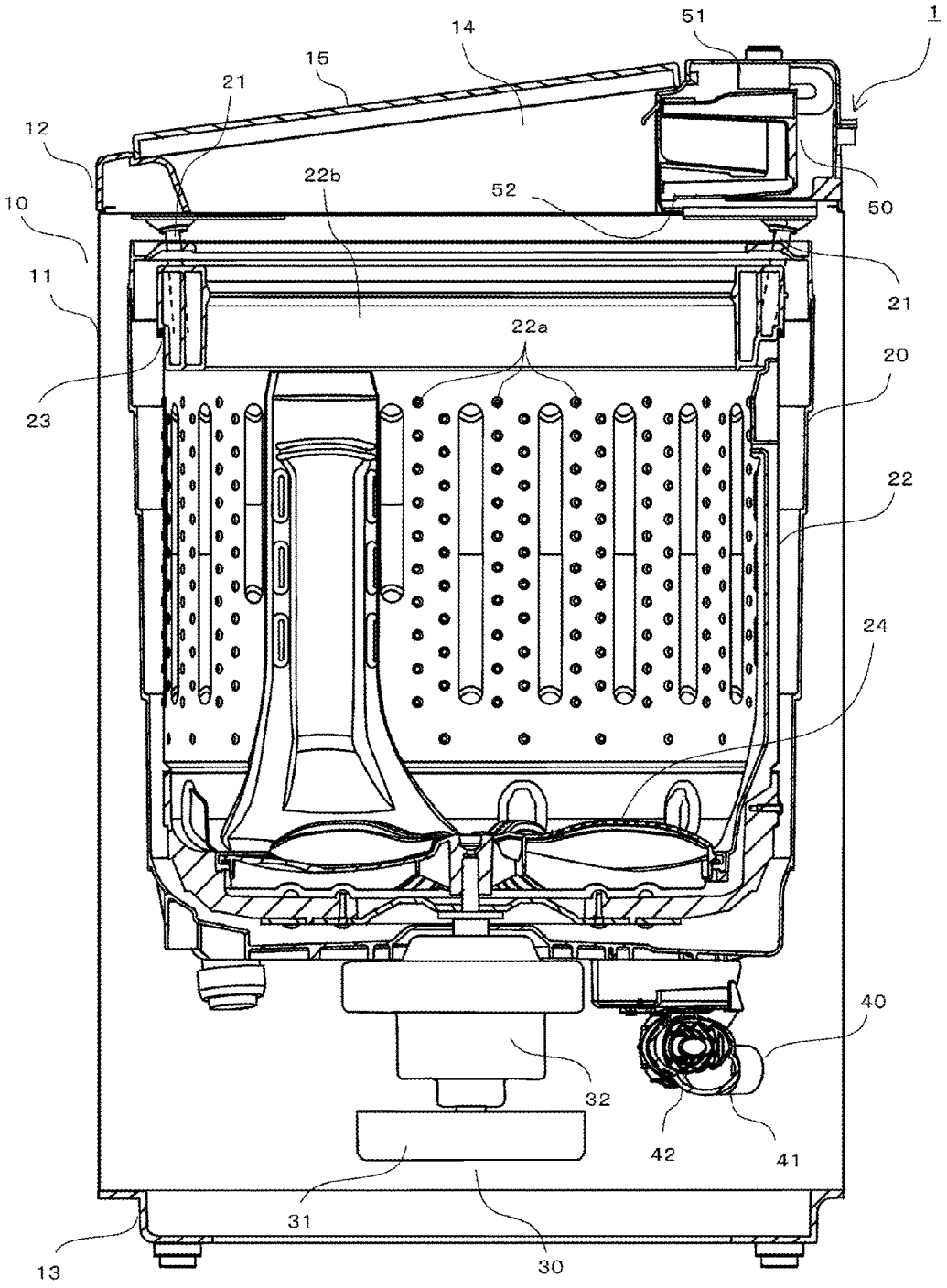
FIG. 2 is a side sectional view showing an internal structure of a full-automatic washing machine involved in embodiments.

FIG. 1 is a main view showing an appearance of a full-automatic washing machine 1. FIG. 2 is a side sectional view showing an internal structure of a full-automatic washing machine 1.

The full-automatic washing machine 1 has a housing 10 forming the appearance. The housing 10 includes: a square tubular machine body part 11 of which an upper and a lower surfaces are opened; an upper panel 12 covering the upper surface of the machine body part 11; and a footstool 13 which supports the machine body part 11. A throwing port 14 of washings is formed on the upper panel 12. The throwing port 14 is covered by an upper cover 15 which can be freely opened and closed.

In the housing 10, an outer tank 20 is elastically supported upwardly by four hanging rods 21 having anti-vibration devices. A washing and dewatering tank 22 is configured in the outer tank 20. In the washing and dewatering tank 22, a plurality of dewatering holes 22*a* are formed in a circumference surface and a balance ring 23 is arranged on an upper part of the washing and dewatering tank 22. Because an inner surface of the balance ring 23 is more convex inwards than an inner surface of the washing and dewatering tank 22, an inner side of the balance ring 23 forms an opening part 22*b* of the upper surface of the washing and dewatering tank 22. An impeller 24 is configured at a bottom of the outer tank 20.

A drive unit 30 configured to drive the washing and dewatering tank 22 and the impeller 24 is configured on an outer bottom of the outer tank 20. The drive unit 30 includes a drive motor 31 and a transfer mechanism 32. The transfer mechanism 32 has a clutch mechanism. Through switching operations performed by the clutch mechanism, in a washing process and a rinsing process, a drive force of the drive motor 31 is only transferred to the impeller 24 so as to only make the impeller 24 rotate. In a dewatering process, a drive force of the drive motor 31 is transferred to the impeller 24 and the washing and dewatering tank 22 so as to make the impeller 24 and the washing and dewatering tank 22 rotate integrally. In addition, the transfer mechanism 32 has a speed reducing mechanism. In a washing process and a rinsing process, the impeller 24 rotates with a reduced speed of a rotational speed of the drive motor 31 in accordance with a deceleration ratio of the speed reducing mechanism.

On the outer bottom of the outer tank 20, a drain unit 40 configured to drain water from the washing and dewatering tank 22 and the outer tank 20 is also configured. The drain unit 40 has a drain pipe 41 and a drain valve 42 and is connected with a drain hose not shown. When the drain valve 42 is opened, water accumulated in the washing and dewatering tank 22 and the outer tank 20 is drained from the washing machine through the drain pipe 41 and the drain hose.

A water supply unit 50 for supplying running water into the washing and dewatering tank 22 is configured at a back part of the upper panel 12. The water supply unit 50 includes a water supply valve 51 connected with a water tap. When the water supply valve 51 is opened, the running water is guided into the water supply unit 50 and flows from a water filling port 52 of the water supply unit 50 into the washing and dewatering tank 22.

Figure 3:
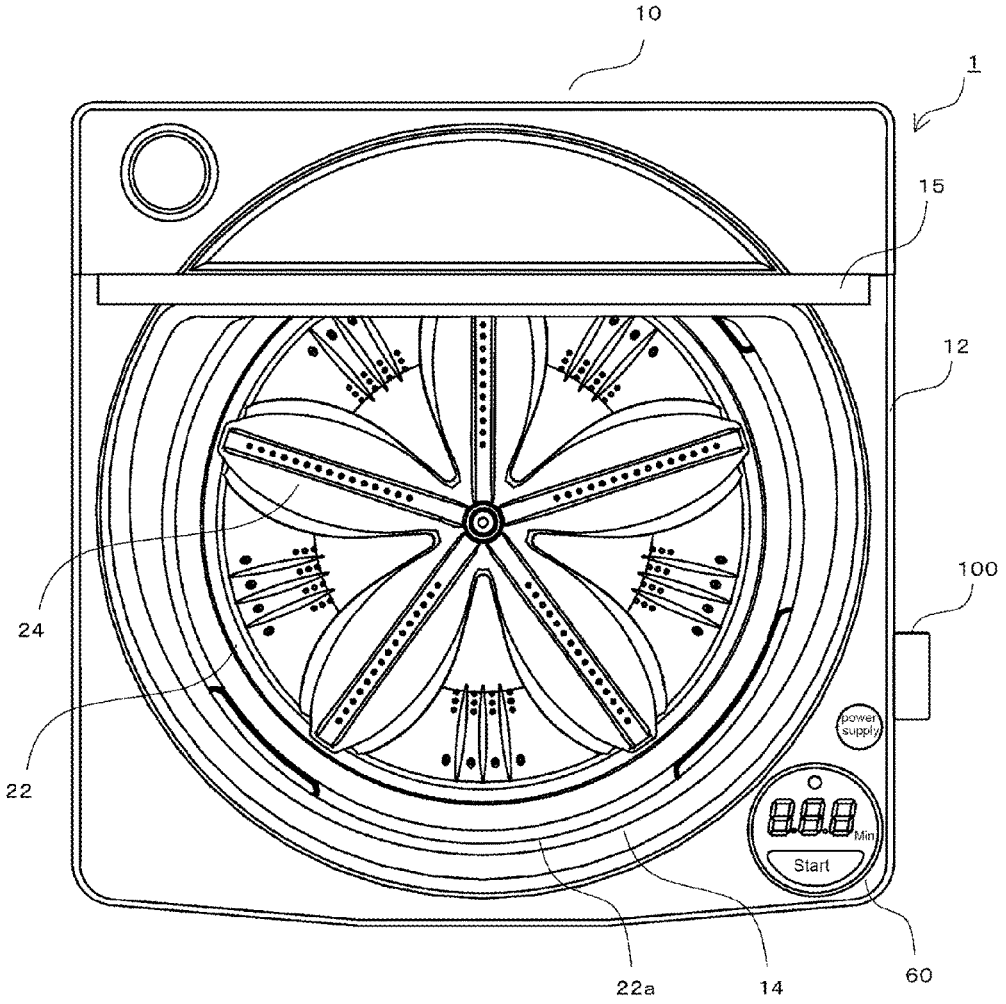
FIG. 3 is a top view showing a full-automatic washing machine on which an upper cover is opened involved in embodiments.
Figure 4:
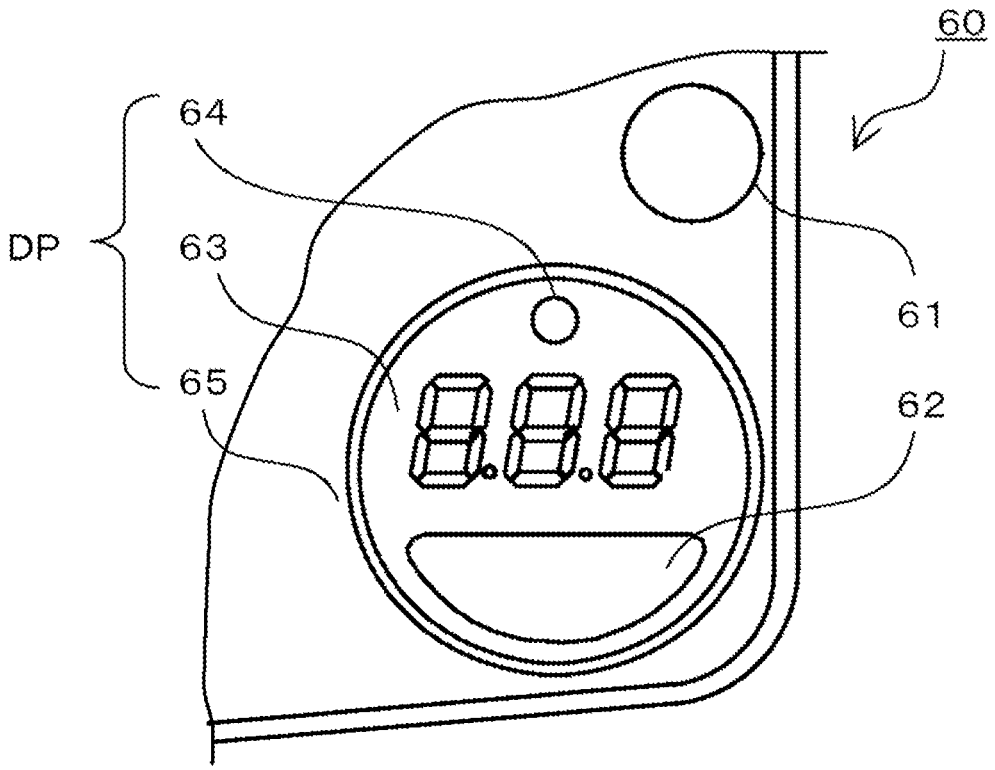
FIG. 4 is an enlarged view showing a main part of an upper panel of a structure of a body operating part involved in embodiments.

FIG. 3 is a top view showing a full-automatic washing machine 1 on which an upper cover 15 is opened. FIG. 4 is an enlarged view showing a main part of an upper panel 12 of a structure of a body operating part 60.

On the upper panel 12, the throwing port 14 forms a shape of a circle besides a straight-line-shaped part on back of the throwing port 14. An inner diameter of the throwing port 14 is made to be larger than an inner diameter of the opening part 22*b* of the washing and dewatering tank 22. That is, an opening of the throwing port 14 is larger than the opening part 22*b* besides a part of the back of the throwing port 14.

A body operating part 60 is arranged on a right front corner of the upper panel 12. As shown in FIG. 4, the body operating part 60 includes a power key 61, a starting key 62, and a body display part DP which is composed of a remaining time display part 63, a door lock display part 64 and a mode display part 65. The power key 61 is a key for switching on and switching off a power supply of a body of the full-automatic washing machine 1. The starting key 62 is a key for starting a washing operation. The remaining time display part 63 includes three seven-segment display LEDs, and the seven-segment display LEDs display remaining time of the washing operation. The door lock display part 64 includes LEDs which are illuminated when the upper cover 15 is in a locked state. The mode display part 65 includes annular phototubes which can emit light and have a plurality of colors, and the phototubes are illuminated in a color corresponding to an operating mode.

Figure 5:
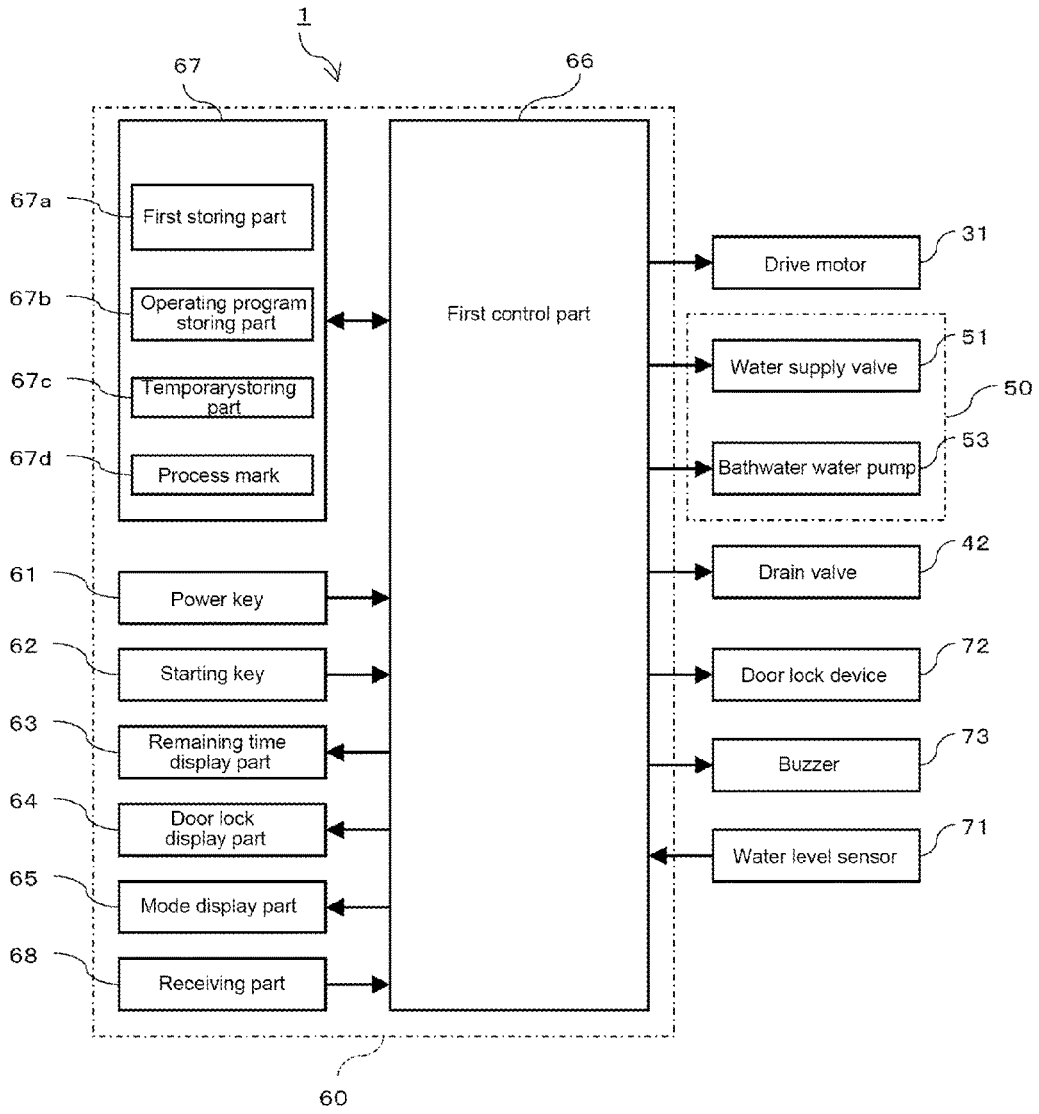
FIG. 5 is a block diagram showing a structure of a full-automatic washing machine involved in embodiments.

FIG. 5 is a block diagram showing a structure of the full-automatic washing machine 1.

The body operating part 60 further includes a first control part 66, a first storing part 67 and a receiving part 68 besides the power key 61, the starting key 62, the remaining time display part 63, the door lock display part 64 and the mode display part 65.

In addition, the water supply unit 50 includes a bathwater water pump 53. The bathwater water pump 53 is connected with a bathwater hose not shown in figures. Under a state that a water absorbing port part of the bathwater hose is put into a bathtub accumulated with remaining hot water, when the bathwater water pump 53 is operated, the bathwater is pumped up and the pumped bathwater is supplied into the washing and dewatering tank 22 from the water filling port 52 of the water supply unit 50.

Then, the full-automatic washing machine 1 is provided with a water level sensor 71 for detecting a water level in the washing and dewatering tank 22; a door lock device 72 for locking the closed upper cover 15; and a buzzer 73 for outputting ending sounds indicating an end of a washing operation, and anomaly notifying sounds indicating generation of anomaly, etc.

The first storing part 67 includes EEPROM, RAM, etc. The first storing part 67 has: an operating program storing part 67*a*, an operating condition storing part 67*b*, a temporary storing part 67*c* and a process mark 67*d*. The operating program storing part 67*a*, the operating condition storing part 67*b* and the process mark 67*d* are arranged on the EEPROM, and the temporary storing part 67*c* is arranged on the RAM.

The operating program storing part 67*a* stores operating programs of various operating processes of a standard process, a self-shunting process, a quick washing process, a drying process, a blanket process and a tank washing process which can be executed by the full-automatic washing machine 1. The standard process is an operating program for ordinary washing. The self-shunting process is an operating process for a washing operation under various operating conditions set by a user, where a set value is stored, and identical operating conditions are also used in a washing operation of a next self-shunting process. The quick washing process is an operating process used in quick washing. The drying process is an operating process for washing diaphanous clothes. The blanket process is an operating process for washing blankets. The tank washing process is an operating process for washing the washing and dewatering tank 22.

The operating condition storing part 67*b* stores various operating conditions of a water level, washing time, number of rinsing times and dewatering time in a unit of each operating process. FIG. 6 shows one example indicating operating conditions stored in the operating condition storing part 67*b*. Various operating conditions are set as standard values in the standard process. In the self-shunting process, various operating conditions as initial values are set as same values as those in the standard process, and various operating conditions are updated as new values when newly set by the user. In the quick washing process, various operating conditions are set in a mode that each operating time becomes short. Various operating conditions are set as values suitable for washing diaphanous clothes in the drying process. Various operating conditions are set as values suitable for washing blankets in the blanket process. Various operating conditions are set as values suitable for washing the washing and dewatering tank 22 in the tank washing process. In addition, in an initial stage of a washing operation like the standard process and the self-shunting process, under a condition of setting a water level as "automatic", a known load amount detecting method is used for detecting a load amount of washings in the washing and dewatering tank 22, and the water level is determined according to the detected load amount.

The temporary storing part 67*c* stores operating processes set as operating processes which should be executed, as well as operating conditions related to operating programs. The process mark 67*d* is a mark for keeping an operating process executed finally. The process mark 67*d* has bits corresponding to various operating processes, and a bit of an operating process executed finally is created from the bits.

The first storing part 67 further stores a program for executing an aftermentioned main control processing of the full-automatic washing machine 1.

The first control part 66 controls various loads of the remaining time display part 63, the door lock display part 64, the mode display part 65, the drive motor 31, the water supply valve 51, the bathwater water pump 53, the drain valve 42, the door lock device 72, the buzzer 73 and the like according to programs stored in the first storing part 67 based on various signals from the power key 61, the starting key 62, the receiving part 68, water level sensor 71, etc.

The receiving part 68 receives wireless signals transmitted from an aftermentioned remote controller 100, converts the received wireless signals into operating information (operating processes and operating conditions) and outputs the operating information to the first control part 66.

The full-automatic washing machine 1 performs a washing operation of operating processes selected from a plurality of above operating processes by the user. The washing operation includes a washing process, an intermediate dewatering process, a rinsing process and a final dewatering process.

In the washing process and the rinsing process, in a state that water is accumulated in the washing and dewatering tank 22, the impeller 24 rotates in a left direction and a right direction. A water flow is generated in the washing and dewatering tank 22 through rotation of the impeller 24. In the washing process, washings are washed through the generated water flow and detergents contained in water. In the rinsing process, washings are rinsed through the generated water flow. In the intermediate dewatering process and the final dewatering process, the washing and dewatering tank 22 and the impeller 24 rotate integrally at a high speed. Washings are dewatered through a centrifugal effect generated in the washing and dewatering tank 22.

Figure 7:
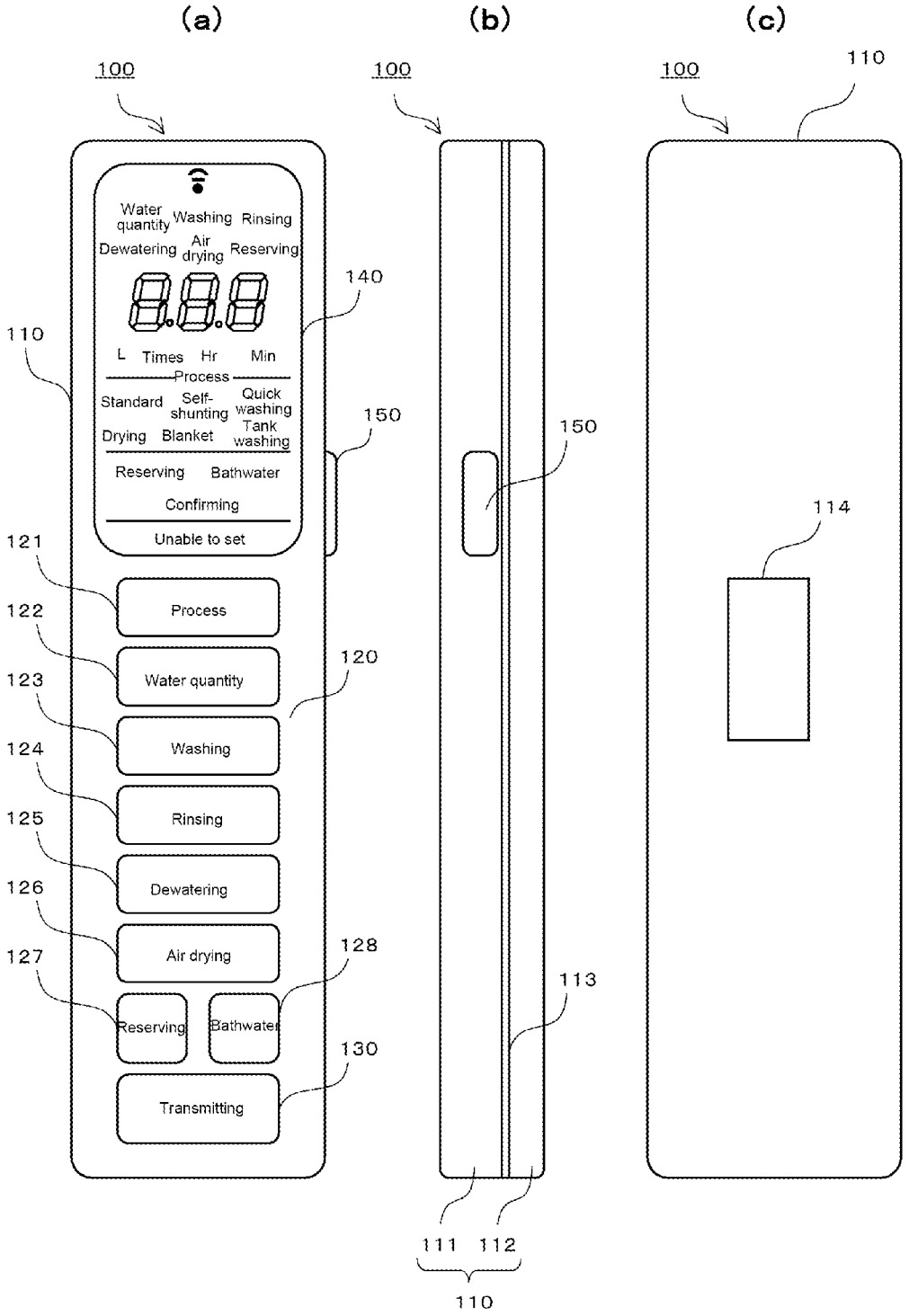
FIG. 7 a diagram showing a main view, a right view and a back view of a structure of a remote controller involved in embodiments.

The full-automatic washing machine 1 has a remote controller 100 as a setting operating part. FIGS. 7(*a*), (*b*) and (*c*) respectively indicate a main view, a right view and a back view of a structure of the remote controller 100.

The remote controller 100 includes a housing 110; a setting key group 120, a transmitting key 130 and an information display part 140 arranged on a front surface of the housing 110; and a confirming key 150 arranged on a right side surface of the housing 110.

The housing 110 is composed of an upper housing 111 and a lower housing 112. A gasket 113 is inserted between the upper housing 111 and the lower housing 112, so as to prevent water from entering the housing 110. A magnet 114 is arranged on a back surface of the housing 110. The machine body part 11 of the housing 10 of the full-automatic washing machine 1 is formed by a steel plate as a magnetic body. Thus, as shown in FIG. 3, through magnetic force of the magnet 114, the remote controller 100 can be detachably installed on a side surface and a front surface of the housing 10. In addition, the magnetic force of the magnet 114 may be of a strength which may not cause separation of the remote controller 100 due to vibration of the housing 10 during dewatering.

The setting key group 120 is composed of various setting keys for setting various operating information, i.e., a process key 121 for setting operating processes, a water quantity key 122 for setting water quantity, a washing key 123 for setting washing time, a rinsing key 124 for setting number of rinsing times, a dewatering key 125 for setting dewatering time, a drying key 126 for setting drying time of air drying, a reserving key 127 for setting reserving time, and a bathwater key 128 for setting existence of water supply of bathwater.

The transmitting key 130 is a key for transmitting set operating information. The confirming key 150 is a key for confirming details of an operating process during setting or an operating process which is set finally.

The information display part 140 is, for example, a liquid crystal display. The information display part 140 displays operating information set by the setting key group 120. In addition, the information display part 140 displays details of the operating processes based on pressing down of the confirming key 150. In addition, in FIG. 7(*a*), the information display part 140 represents all displayed information for convenience.

Figure 8:
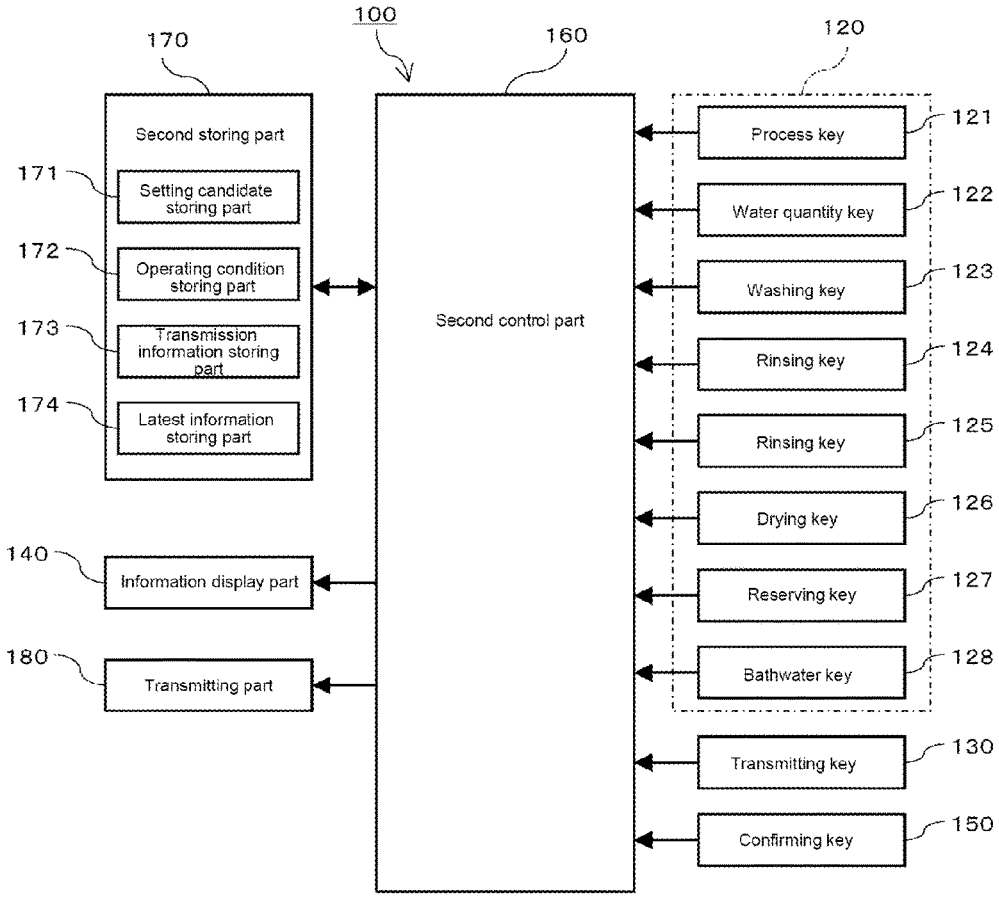
FIG. 8 is a block diagram showing a structure of a remote controller involved in embodiments.

FIG. 8 is a block diagram showing a structure of the remote controller 100. A second control part 160, a second storing part 170 and a transmitting part 180 are configured in the housing 110.

The second storing part 170 includes EEPROM, RAM, etc. The second storing part 170 has a setting candidate storing part 171, an operating condition storing part 172, a transmission information storing part 173 and a latest information storing part 174. The setting candidate storing part 171, the operating condition storing part 172 and the latest information storing part 174 are arranged on the EEPROM, and the transmission information storing part 173 is arranged on the RAM.

FIGS. 9(*a*) to 9(*c*) are diagrams showing one example of operating information stored in the setting candidate storing part 171, the transmission information storing part 173 and the latest information storing part 174.

The setting candidate storing part 171, as shown in FIG. 9(*a*), stores operating information forming setting candidates during setting based on the setting key group 120. The operating condition storing part 172 is as same as the operating condition storing part 67*b* of the body operating part 60, and stores various operating conditions of a water level, washing time, number of rinsing times and dewatering time in a unit of each operating process (referring to FIG. 6). The transmission information storing part 173 stores various operating information set by the setting key group 120. An example of the transmission information storing part 173 for storing operating information related to operating processes, water quantity, the washing time, the reserving time and a bathwater water supply is shown in FIG. 9(*b*). The latest information storing part 174 stores operating information finally transmitted to the body operating part 60. An example of the latest information storing part 174 for storing operating information related to the standard process in which the reserving time and the bathwater water supply are added is shown in FIG. 9(*c*).

The transmitting part 180 converts the operating information set by the setting key group 120 and stored in the transmission information storing part 173 into wireless signals, and transmits the converted wireless signals to the receiving part 68 of the body operating part 60. The wireless signals may also be any wireless signal such as infrared rays, electric waves, etc.

Under a condition of performing a washing operation, the user presses the power key 61 to energize the body of the full-automatic washing machine 1. When a power supply is switched on, the body of the full-automatic washing machine 1 is subjected to a main control processing by the first control part 66.

Figure 10:
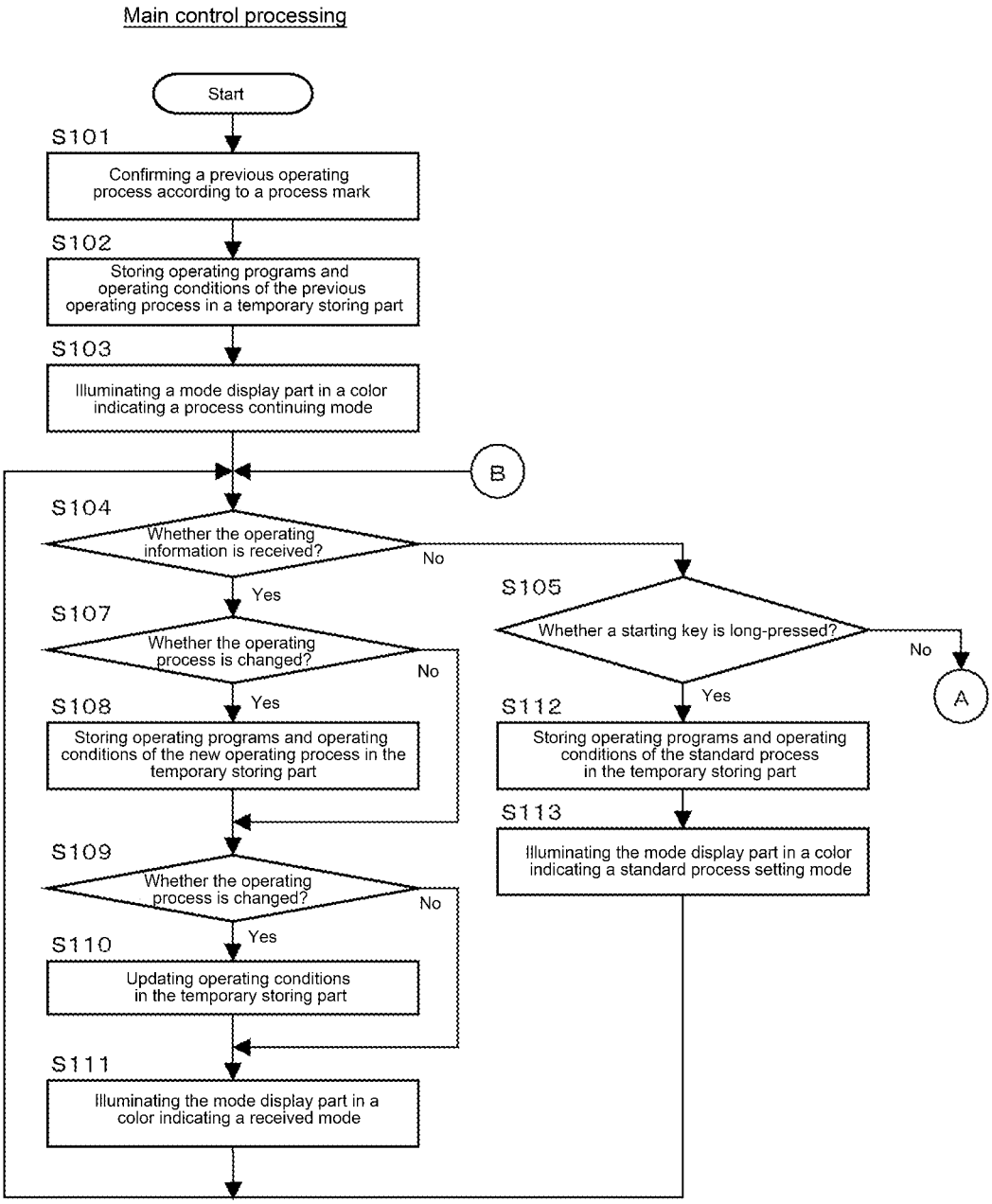
FIG. 10 is a flow chart showing a main control processing involved in embodiments.
Figure 11:
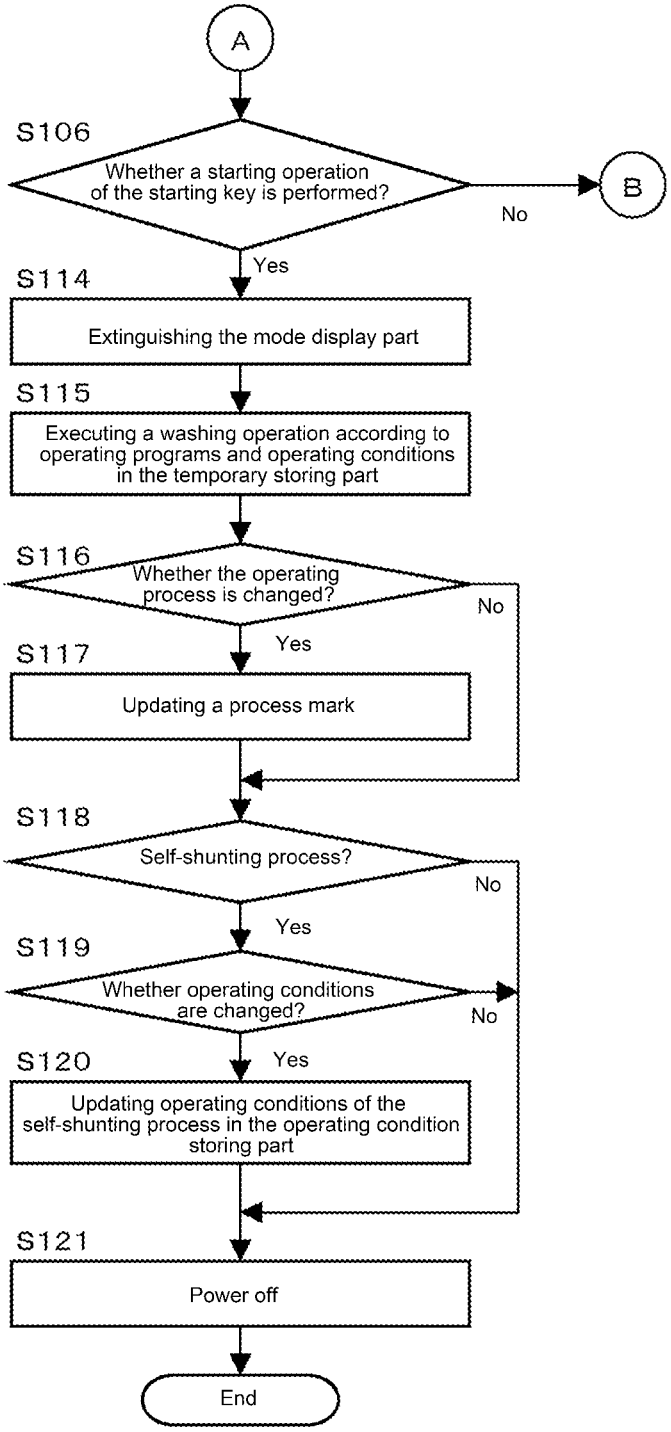
FIG. 11 is a flow chart showing a main control processing involved in embodiments.
Figure 12:
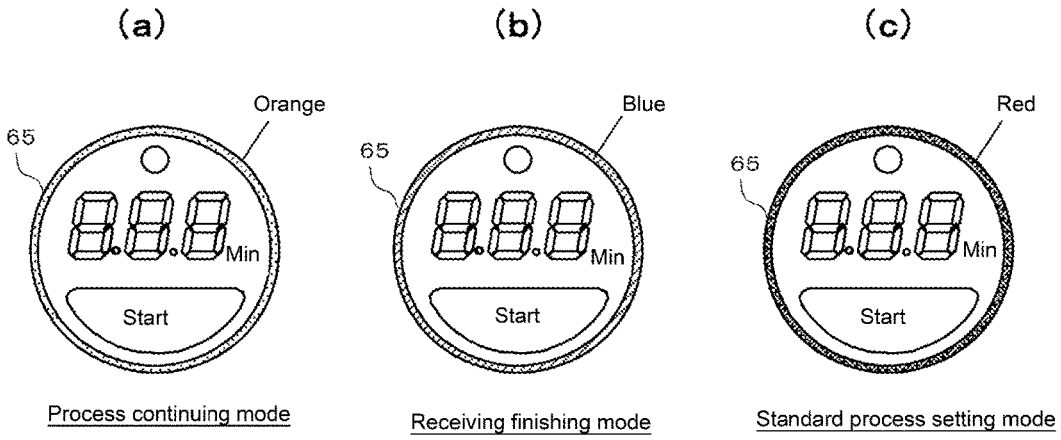
FIG. 12 is a diagram showing a condition of illuminating a mode display part according to an operating mode involved in embodiments.

FIG. 10 and FIG. 11 are flow charts showing the main control processing. FIGS. 12(*a*) to 12(*c*) are diagrams showing a condition of illuminating the display part 65 according to an operating mode.

When the body of the full-automatic washing machine 1 is energized, the first control part 66 confirms a previous operating process (S101) by referring to the process mark 67*d*. Next, the first control part 66 reads an operating program of the previous operating process from the storing part 67*a*, and reads operating conditions related to the previous operating process from the operating condition storing part 67*b*, so that the read operating program and operating conditions are stored in the temporary storing part 67*c* (S102). Then the first control part 66, as shown in FIG. 12(*a*), illuminates the mode display part 65 in a color such as orange indicating that an operating mode is in a state of a process continuing mode of continuing the previous operating process (S103).

Next, the first control part 66 judges whether the operating information is received from the remote controller 100, whether a long pressing operation is performed on the starting key 62 and whether a starting operation is performed on the starting key 62 (S104, S105 and S106). The first control part 66 judges that the long pressing operation is performed under a condition that the starting key 62 is continuously pressed over certain time (e.g., 6 seconds), and judges that the starting operation is performed under a condition that the starting key 62 is continuously pressed less than the certain time.

Under a condition that a washing operation of an operating process different from the previous operating process is performed, or under a condition that an operating process is identical with the previous operating process while a washing operation is performed with changed operating conditions of washing time, number of rinsing times and the like, the user uses the remote controller 100 to set operating information (operating processes and operating conditions), and transmits the set operating information. A setting method based on the operating information of the remote controller 100 is described in detail below.

Under a condition that an operating information is already received (S104: Yes), the first control part 66 judges whether a change of an operating process exists (S107). Under a condition that the received operating information includes an operating program different from the previous operating process, the first control part 66 judges that the change of the operating process exists. Under a condition that the change of the operating process exists (S107: Yes), the first control part 66 reads an operating program of a new operating process from the operating program storing part 67*a*, and reads operating conditions related to the new operating process from the operating condition storing part 67*b*, and stores the read operating program and operating conditions in the temporary storing part 67*c* (S108). In this way, the new operating process is set as an operating process which should be executed.

Next, the first control part 66 judges whether a change of operating conditions exists (S109). Under a condition that the received operating information includes operating conditions different from operating conditions stored in the temporary storing part 67*c*, the first control part 66 judges that the change of operating conditions exists. In addition, under a condition that the change of the operating process exists, during the judgment, operating conditions stored in the temporary storing part 67*c* are operating conditions of the new operating process, and are operating conditions of the previous operating process as long as there is no change of the operating process. Under a condition that the change of operating conditions exists (S109: Yes), the first control part 66 updates operating conditions in the temporary storing part 67*c* (S110). Then the first control part 66, as shown in FIG. 12(*b*), illuminates the mode display part 65 in a color such as blue indicating that an operating mode is in a state of a reception ending mode of ending reception of the operating information from the remote controller 100 (S111).

A condition that the remote controller 100 is taken to a place away from an installing place of the body of the full-automatic washing machine 1 by the user is considered. In this way, a condition that the remote controller 100 is not on a hand of the user during a washing operation may also happen. In the present embodiment, under a condition that the previous operating process is an operating process other than a standard process, even if the remote controller is not on the hand of the user, the starting key 62 of the body operating part 60 can also be used for changing the operating process into the standard process.

Under a condition that the operating process is changed into the standard process, the user performs a long pressing operation on the starting key 62. When judging that the long pressing operation is performed (S105: Yes), the first control part 66 reads an operating program of the standard process from the operating program storing part 67*a*, and reads operating conditions related to the standard process from the operating condition storing part 67*b*, so that the read operating program and operating conditions are stored in the temporary storing part 67*c* (S112). In this way, the standard process is set as an operating process which should be executed. Then the first control part 66, as shown in FIG. 12(*c*), illuminates the mode display part 65 in a color such as red indicating that an operating mode is in a state of a standard process setting mode of the standard process set to be based on the long pressing operation (S113).

When the operating process and operating conditions are not changed or are changed into expected operating process and operating conditions, the user performs a starting operation on the starting key 62. When the first control part 66 judges that the starting operation is performed on the starting key 62 (106: Yes), the mode display part 65 is extinguished (S114). Then the first control part 66 executes a washing operation according to the operating programs and operating conditions stored in the temporary storing part 67*c* (S115).

Under a condition that water quantity, washing time, number of rinsing times and dewatering time are set by the remote controller 100, a washing process, a rinsing process and a dewatering process are performed with the set water quantity, washing time, number of rinsing times and dewatering time. In addition, under a condition that drying time of air drying is set by the remote controller 100, an air drying process is added after a final dewatering process. In the air drying process, the washing and dewatering tank 22 generates a centrifugal force through a high-speed rotation, introduces wind from a ventilation port (not shown in figures) arranged on an upper cover 15 into the washing and dewatering tank 22, and dries washings through effects of the centrifugal force and the wind. Then under a condition that reserving time is set by the remote controller 100, a washing operation is started in a mode of ending the washing operation within the reserving time. Then under a condition that a bathwater water supply is set by the remote controller 100, the running water is replaced by bathwater which is supplied into the washing and dewatering tank 22 in the washing process. In addition, as to the washing time, number of rinsing times and the dewatering time, under a condition that a "none" setting is made, a process which is set as "none" is not performed. In any operating process, under a condition that the drying time of air drying, the reserving time and the bathwater water supply are set, when a "none" setting is made regarding above conditions, the setting is released.

When the washing operation is ended, as long as the executed operating process is obtained through changing the previous operating process (S116: Yes), the first control part 66 updates the process mark 67*d* in a mode of keeping a new operating process (S117). Then under a condition that an executed operating process is a self-shunting process and operating conditions are changed (S118: Yes→S119: Yes), the first control part 66 updates operating conditions of the self-shunting process stored in the operating condition storing part 67*b* (S120). Then the first control part 66 deenergizes the body of the full-automatic washing machine 1 (S121), and ends the main control processing.

Next, a setting method of operating information performed by the remote controller 100 is described.

In the remote controller 100, a second control part 160 executes a setting and transmission processing for setting operating information and transmitting the operating information to the body operating part 60.

Figure 13:
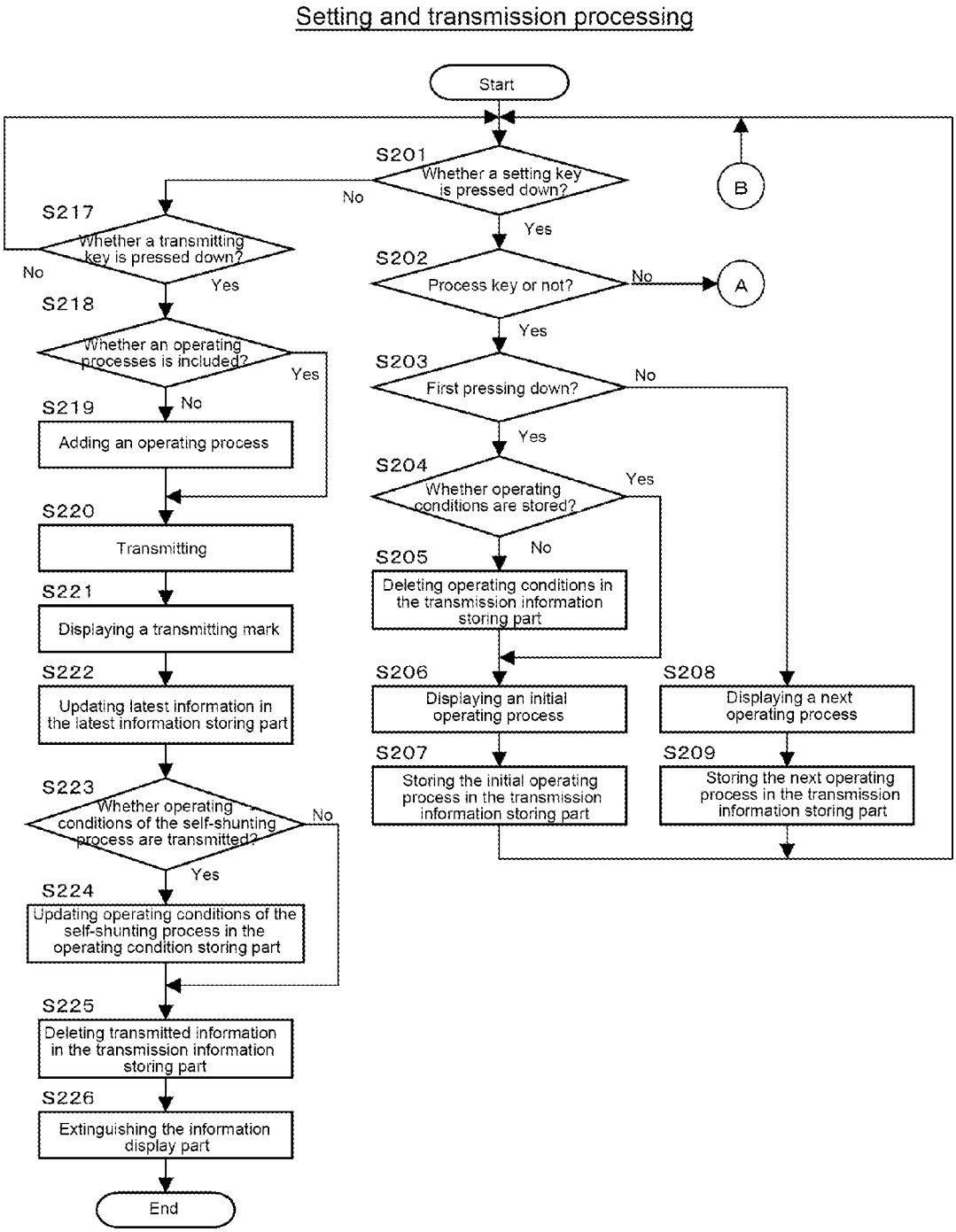
FIG. 13 is a flow chart showing setting of a transmission processing involved in embodiments.
Figure 14:
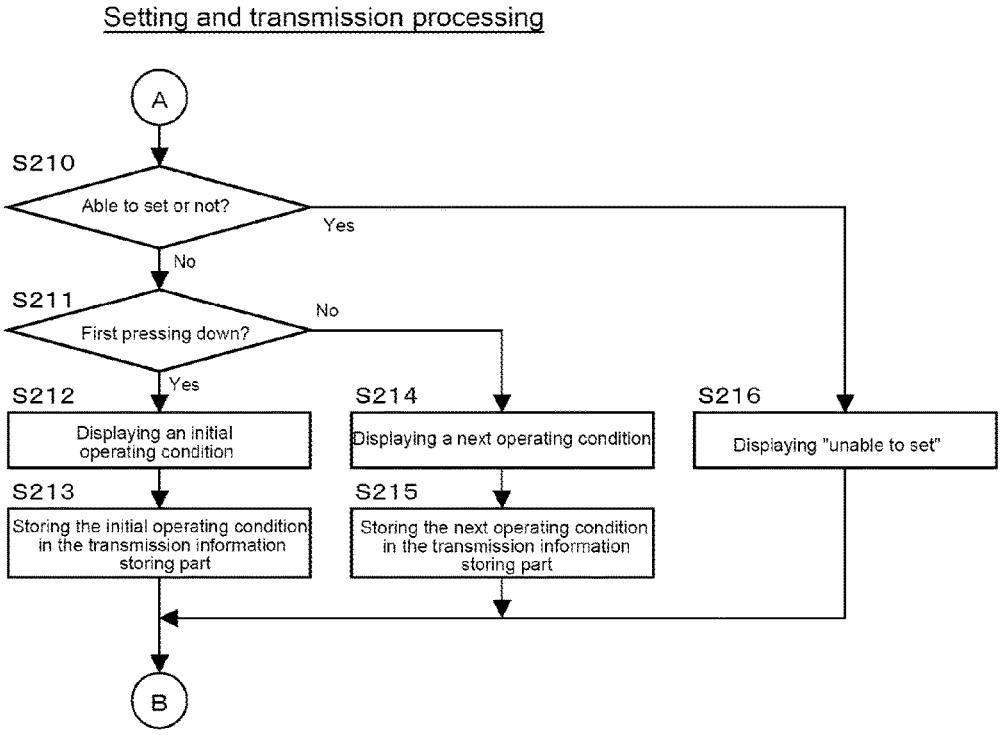
FIG. 14 is a flow chart showing setting of a transmission processing involved in embodiments.
Figure 15:
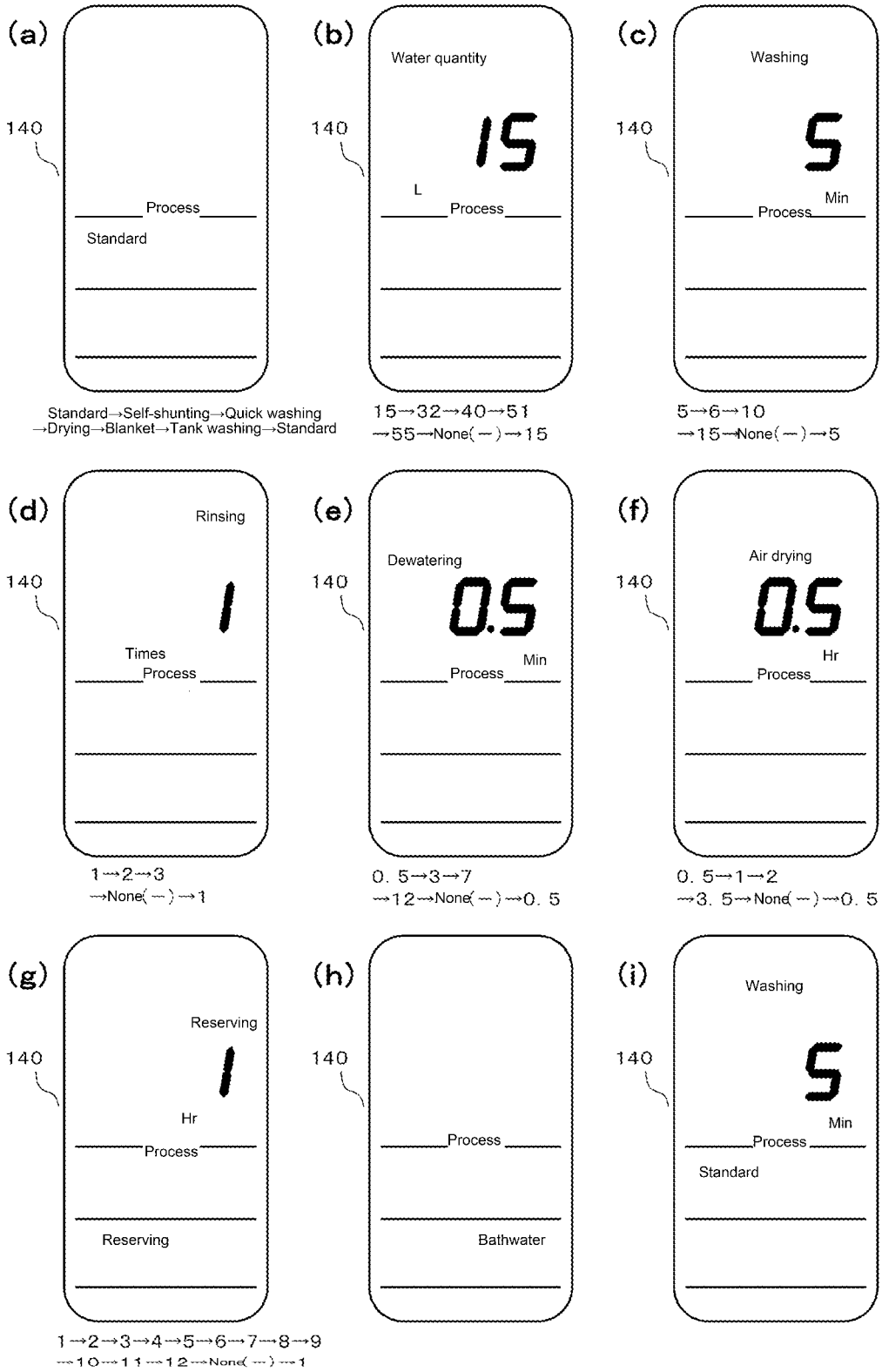
FIG. 15 is a diagram showing a condition of displaying set operating information by the information display part involved in embodiments.
Figure 16:
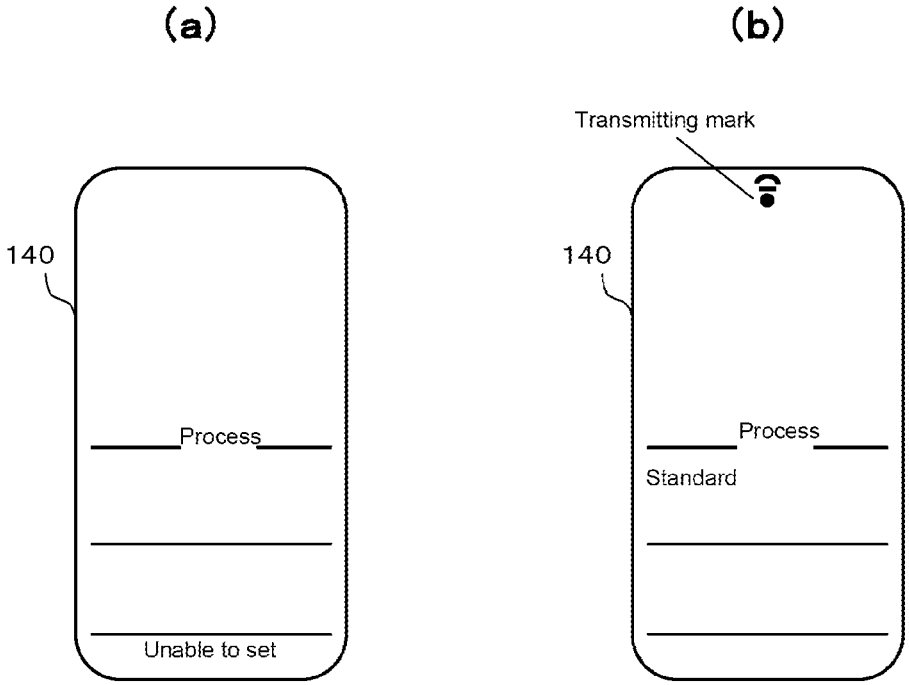
FIG. 16 is a diagram showing an information display part displaying information which indicates that operating conditions cannot be set as well as an information display part displaying a transmitting mark involved in embodiments.

FIG. 13 and FIG. 14 are flow charts showing a setting and transmission processing. FIGS. 15(*a*) to 15(*i*) are diagrams showing a condition of set operating information displayed by the information display part 140. FIG. 16(*a*) is a diagram showing an information display part 140 displaying information which indicates that operating conditions cannot be set. FIG. 16(*b*) is a diagram showing the information display part 140 displaying a transmitting mark.

The second control part 160 monitors whether any setting key of the setting key group 120 is pressed down (S201). When any setting key is pressed down (S201: Yes), the second control part 160 judges whether the setting key being pressed down is a process key 121 (S202).

Under a condition that the user sets an operating process, the process key 121 is pressed down. Under a condition that the process key 121 is already pressed down (S202: Yes), as long as the pressing down of the process key 121 is a first pressing down (S203: Yes), the second control part 160 judges whether operating conditions are stored in the transmission information storing part 173 before the pressing down of the process key 121 (S204).

Under a condition that a new operating program is set, operating conditions of the previous operating process cannot be used. Therefore, under a condition that operating conditions are stored in the transmission information storing part 173 (S204: Yes), the second control part 160 deletes stored operating conditions (S205). Then the second control part 160 displays a first operating process in a predetermined display sequence on the information display part 140 (S206). For example, under a condition of a standard process, as shown in FIG. 13(*a*), a display region of operating processes in the information display part 140 displays a word "standard". Then the second control part 160 stores the first operating process in the transmission information storing part 173 (S207).

Under a condition that an operating process displayed earliest is not an expected operating process, the process key 121 is pressed down again by the user. Under a condition that the pressing down of the process key 121 is not the first pressing down (S203: No), the second control part 160 displays a next operating process in the display sequence on the information display part 140 (S208). As shown in FIG. 15(*a*), when the process key 121 is pressed down each time, a display of operating processes in the information display part 140 is switched in accordance with the display sequence. Then the second control part 160 replaces a next operating process by a previously stored operating process and stores the next operating process in the transmission information storing part 173 (S209). In this way, the transmission information storing part 173 stores an operating process finally selected by the user.

Under a condition of continuing to maintain a previous operating process and only changing or adding operating conditions, or under a condition that, after a new operating process is set, operating conditions related to the operating process are changed or added, the user presses down setting keys corresponding to operating conditions to be changed or added.

Under a condition that any setting key of the setting key group 120 is pressed down and the setting key being pressed down is not the process key 121 (S201: Yes→S202: No), the second control part 160 judges whether setting of operating conditions can be performed through the setting key being pressed down (S210).

In the present embodiment, in the standard process, the self-shunting process and the quick washing process, setting of all operating conditions of water quantity, washing time, number of rinsing times, dewatering time, drying time of air drying, reserving time and bathwater water supply can be performed. In addition, in the drying process and the blanket process, although the water quantity, washing time, number of rinsing times, dewatering time and drying time of air drying cannot be set, an existence of the reserving time and bathwater water supply can be set. In the tank washing process, any operating condition cannot be set.

Under a condition of firstly setting an operating process prior to operating conditions, the second control part 160 judges whether a setting can be performed according to operating processes stored in the transmission information storing part 173. On the other hand, under a condition that no operating process is set, the second control part 160 judges whether a setting can be performed according to operating processes stored in the latest information storing part 174.

Under a condition that operating conditions can be set through the setting key being pressed down (S210: Yes), when the pressing down of the setting key is the first pressing down (S211: Yes), the second control part 160 displays a first operating condition corresponding to the setting key being pressed down in the predetermined display sequence on the information display part 140 (S212) and stores the first operating condition in the transmission information storing part 173 (S213). On the other hand, as long as the pressing down of the setting key is not the first pressing down (S211: No), the second control part 160 displays a next operating condition corresponding to the setting key being pressed down in the display sequence on the information display part 140 (S214) and stores the next operating condition in the transmission information storing part 173 (S215). An operating condition finally selected by the user is stored in the transmission information storing part 173.

Under a condition that the water quantity key 122 is pressed down, as shown in FIG. 15(*b*), the information display part 140 displays initial water quantity, e.g., "15 liters", and then switches display of water quantity when the water quantity key 122 is pressed down each time. Under a condition that the washing key 123 is pressed down, as shown in FIG. 15(*c*), the information display part 140 displays initial washing time, e.g., "5 minutes", and then switches display of the washing time when the washing key 123 is pressed down each time. Under a condition that the rinsing key 124 is pressed down, as shown in FIG. 15(*d*), the information display part 140 displays number of initial rinsing times, e.g., "1 time", and then switches display of number of rinsing times when the rinsing key 124 is pressed down each time. Under a condition that the dewatering key 125 is pressed down, as shown in FIG. 15(*e*), the information display part 140 displays initial dewatering time, e.g., "0.5 minute", and then switches display of the dewatering time when the dewatering key 125 is pressed down each time. Under a condition that the drying key 126 is pressed down, as shown in FIG. 15(*f*), the information display part 140 displays initial drying time, e.g., "0.5 hour", and then switches display of the drying time when the drying key 126 is pressed down each time. Under a condition that the reserving key 127 is pressed down, as shown in FIG. 15(*g*), the information display part 140 displays initial reserving time, e.g., "1 hour", and then switches display of the reserving time when the reserving key 127 is pressed down each time. Under a condition that the bathwater key 128 is pressed down, as shown in FIG. 15(*h*), a lower display region of the information display part 140 displays a word "bathwater" indicating that a bathwater water supply is set, and next, when the bathwater key 128 is pressed down, the word "bathwater" is deleted. In addition, under a condition that a "none" setting is performed through the water quantity key 122, the washing key 123, the rinsing key 124, the dewatering key 125, the drying key 126 and the reserving key 127, the information display part 140 displays a transverse color bar ("-"). In addition, the information display part 140 displays words indicating various operating conditions of "washing", "rinsing" and the like according to pressing down of each setting key based on values of various operating conditions. A reserving condition is shown in FIG. 15(*g*), and the lower display region of the information display part 140 also displays a word "reserving" which indicates existence of a reserving setting. Then, under a condition that an operating process is firstly set prior to setting of operating conditions, as shown in FIG. 15(*i*), the display region of operating processes of the information display part 140 displays the operating process.

In addition, in step S210, under a condition that the second control part 160 judges that operating conditions cannot be set through the setting key being pressed down (S210: No), as shown in FIG. 16(*a*), information indicating that operating conditions cannot be set is displayed on the information display part 140 (S216).

The second control part 160 monitors whether the setting key is pressed down, and monitors whether the transmitting key 130 is pressed down (S217).

When setting of operating information by the setting key group 120 is ended, the transmitting key 130 is pressed down by the user. Under a condition that the transmitting key 130 is pressed down (S217: Yes), the second control part 160 judges whether the operating process includes operating information stored in the transmission information storing part 173 (S218). As long as the operating process does not include the operating information (S218: No), the second control part 160 reads an operating process from the latest information storing part 174 and adds the read operating process to the transmitted operating information (S219). Thus, the read operating process is stored in the transmission information storing part 173. The second control part 160 outputs operating information in the transmission information storing part 173 to the transmitting part 180, and transmits the operating information to the transmitting part 180 (S220). During transmission, the second control part 160, as shown in FIG. 16(*b*), displays a transmitting mark on the information display part 140 (S221).

In the remote controller 100, under a condition that an operating process is not set and only operating conditions of washing time and the like are set, on a premise of an operating process transmitted finally, operating conditions related to the operating process are set. On the other hand, as mentioned above, the body operating part 60 sometimes sets a standard process through a long pressing operation of the starting key 62. In this case, an operating process stored in the remote controller 100 is inconsistent with an operating process stored in the body operating part 60. In this case, when only operating conditions are transmitted from the remote controller 100, there is a possibility that some transmitted operating conditions are suitable for a standard process different from an operating process stored in the remote controller 100 so that a washing operation expected by the user cannot be performed. In the present embodiment, through the processing of the above step S221, even if the user only set operating conditions, the body operating part 60 changes the operating process to be consistent with the operating process on a remote controller 100 side since the operating process stored in the remote controller 100 is transmitted. Thus, a washing operation expected by the user can be performed.

When the set operating information is transmitted, the second control part 160 updates operating information in the latest information storing part 174 according to the transmitted operating information (S222). The remote controller 100 stores an operating process executed currently in the full-automatic washing machine 1 and operating conditions related to the operating programs of the operating process. In addition, as long as the transmitted operating information is an operating condition related to a self-shunting process (S223: Yes), the second control part 160 updates operating conditions related to the self-shunting process in the operating condition storing part 172 according to the transmitted operating information (S224).

Then the second control part 160 deletes operating information in the transmission information storing part 173 (S225). Then the second control part 160 extinguishes the information display part 140 (S226), and ends setting of the transmission processing. In addition, although it is not shown in flow charts of FIG. 13 and FIG. 14, the second control part 160 extinguishes the information display part 140 and ends setting of the transmission processing after an operation of any key of the setting key group 120 is performed once and when a state of not generating a key operation lasts for certain time.

In this way, the user can set operating information of operating processes, operating conditions and the like in the remote controller 100, and transmit the set operating information to the body operating part 60 of the body of the full-automatic washing machine 1 through unidirectional wireless communication.

The user can confirm details of an operating process which is being set or finally set by the remote controller 100 according to an operation of the confirming key 150.

An operating information display processing for displaying details of an operating process on the information display part 140 is executed by the second control part 160.

Figure 17:
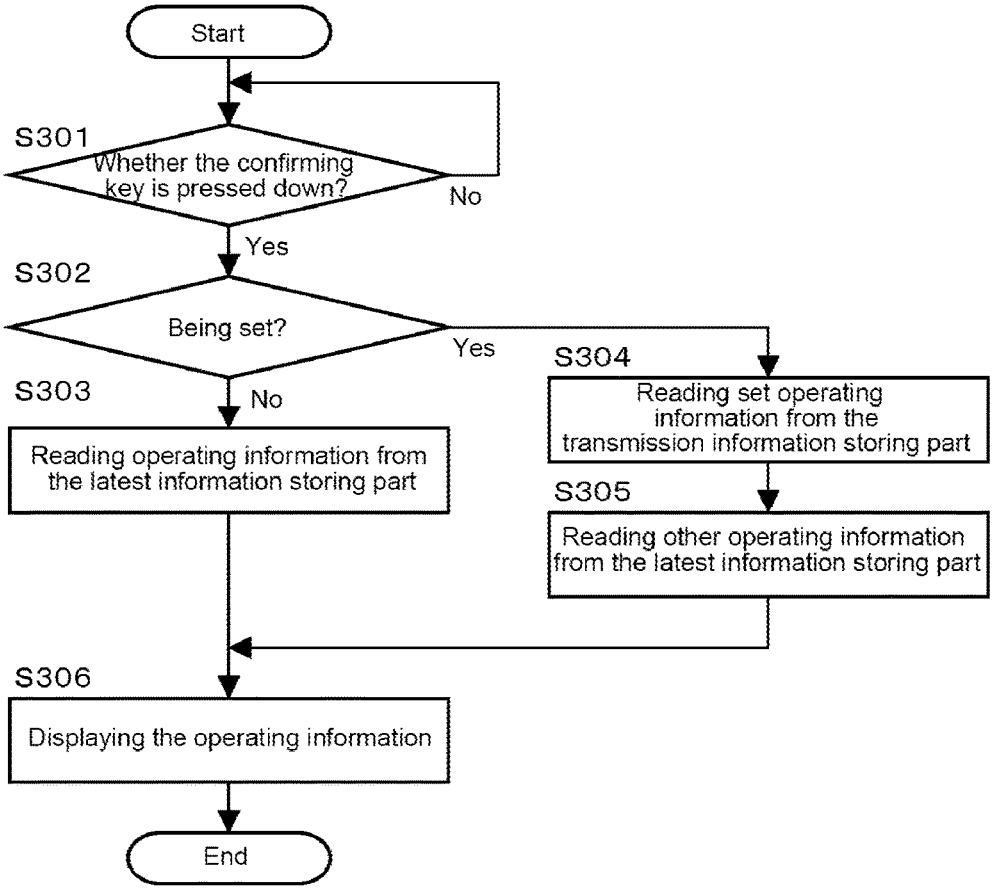
FIG. 17 is a flow chart showing an operating information display processing involved in embodiments.
Figure 18:
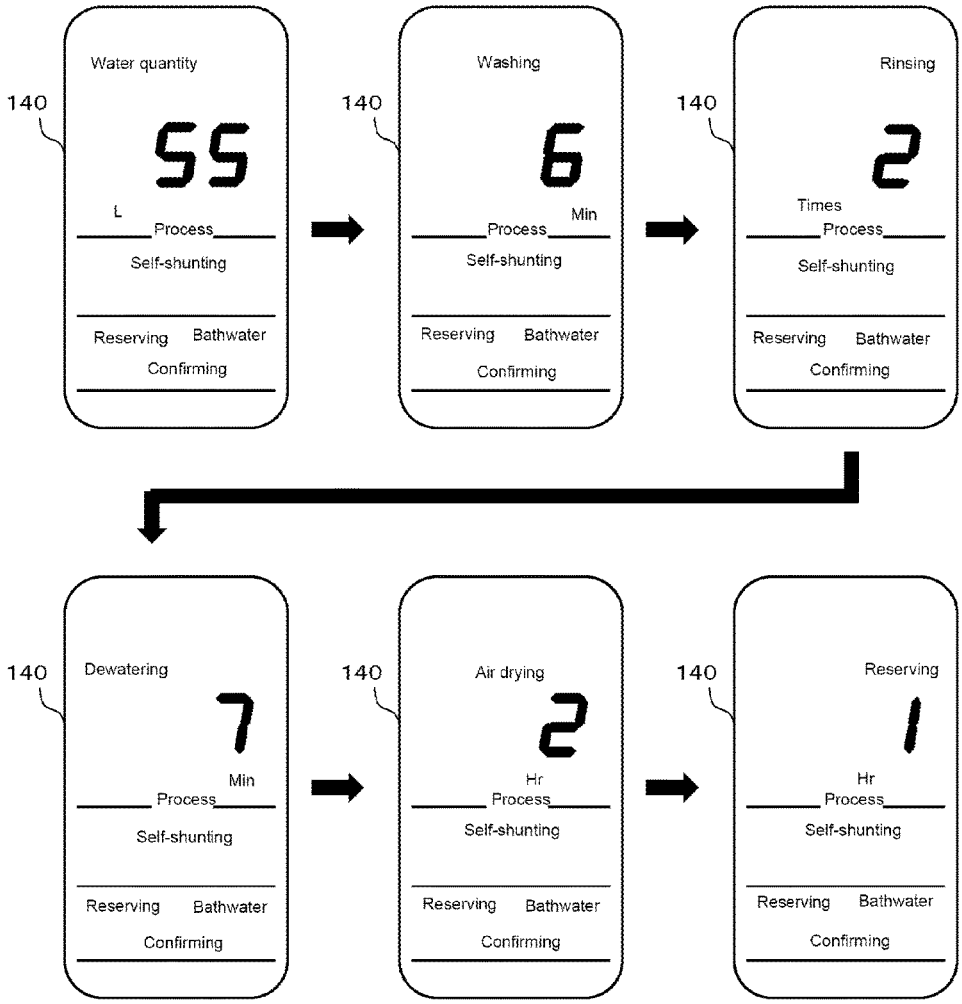
FIG. 18 is a diagram showing an example of a display form when an information display part displays details of operating processes involved in embodiments.

FIG. 17 is a flow chart showing an operating information display processing. FIG. 18 is a diagram showing an example of a display form in case of displaying details of operating processes on the information display part 140.

The second control part 160 monitors whether the confirming key 150 is pressed down (S301). When the confirming key 150 is pressed down (S301: Yes), the second control part 160 judges whether operating information is being set (S302). As long as the operating information is not being set (S302: No), the second control part 160 reads operating information from the latest information storing part 174 (S303). On the other hand, under a condition that the operating information is being set (S302: Yes), the second control part 160 reads the operating information which has been already set from the transmission information storing part 173 (S304), and reads operating information other than the operating information which has been already set from the latest information storing part 174 (S305).

The second control part 160 displays the read operating information, i.e., operating processes and operating conditions, on the information display part 140 (S306). As shown in FIG. 18, the information display part 140 displays an operating process. In addition, the information display part 140 displays water quantity, washing time, number of rinsing times and dewatering time related to the operating process in order, and displays drying time and reserving time in order under a condition that settings of air drying and reserving exist. Then under a condition that setting of reserving and setting of a bathwater water supply exist, the information display part 140 displays words "reserving" and "bathwater" indicating settings of reserving and bathwater water supply. Then the information display part 140 displays a word "confirming" which indicates that a mode of the remote controller 100 is in a state of a mode of details of operating processes. In addition, display of water quantity, washing time, number of rinsing times, dewatering time, drying time and reserving time can be switched when the confirming key 150 is pressed down each time, and can also be switched after certain time each time.

A structure of the present embodiment is described above, and effects generated by the present embodiment are described as follows.

According to the present embodiment, because a communication mode as wireless communication between the remote controller 100 and the body operating part 60 uses a unidirectional communication mode, a simple structure can be made into a structure for communication. In addition, cost and power consumption can be reduced.

Then according to the present embodiment, when the receiving part 68 receives operating information set by the remote controller 100, the mode display part 65 is illuminated in a color corresponding to reception of the operating information until a washing operation starts. Thus, under a condition of using the unidirectional communication mode as stated above, the user can also confirm that the receiving part 68 has received the operating information when an operation of starting the washing operation is performed. Moreover, when the operating information is not received, a washing operation can be started by the user on the basis of performing resetting of operating information. Thus, a washing operation unexpected by the user can be prevented.

In addition, according to the present embodiment, through the long pressing operation of the starting key 62, even if the remote controller 100 is not on the hand, the user can set the standard process with a highest use frequency in the body of the full-automatic washing machine 1. Therefore, use convenience of the user can be optimized. Moreover, when the operating process is set into the standard process based on the long pressing operation, the mode display part 65 is illuminated in a color corresponding to the standard process. Thus, the user can confirm that the long pressing operation is accepted and the operating process is set as the standard process.

Then according to the present embodiment, the user can confirm details of an operating process which is being set or finally set in the remote controller 100 by operating the confirming key 150.

Then according to the present embodiment, the remote controller 100 is provided with a magnet 114, and the machine body part 11 of the housing 10 is formed by a magnetic body. Therefore, the user can easily install the remote controller 100 on the body of the full-automatic washing machine 1.

Then according to the present embodiment, because a front of the throwing port 14 is larger than the opening part 22*b* of the washing and dewatering tank 22, washings can be easily thrown into and withdrawn from the washing and dewatering tank 22 by the user from the front of the full-automatic washing machine 1. Then, because the body display part DP is arranged on the corner having a large space in the upper panel 12, the body display part DP can be expanded.

Although embodiments of the present disclosure are described above, the present disclosure is not limited by above embodiments. In addition, various modifications can also be made to embodiments of the present disclosure except for above embodiments.

For example, in above embodiments, by enabling the mode display part 65 to have different colors, a notification of various operating modes of a process continuing mode, a reception ending mode and a standard process setting mode is performed. However, as shown in FIG. 19(*a*), the mode display part 65 may also not be arranged in the body operating part 60, and corresponding operating modes are displayed in color bars with different colors on the remaining time display part 63. In addition, as shown in FIG. 19(*b*), in the remaining time display part 63, positions of the seven-segment display LEDs illuminated corresponding to operating modes can also be changed. That is, display modes corresponding to various operating modes can be any mode. Under a condition of a structure of FIG. 19(*b*), then in positions below each seven-segment display LED on a right front corner of the upper panel 12, names and abbreviations of each corresponding operating mode can also be printed.

Then in above embodiments, a structure of not illuminating the mode display part 65 and the remaining time display part 63 can also be adopted when an operating mode is the process continuing mode, i.e., before it is changed into the reception ending mode or the standard process setting mode.

Then in above embodiments, display which indicates the reception ending mode, i.e., display corresponding to the reception of the operating information, is ended when just started based on the started washing operation. However, display corresponding to the reception of the operating information can also be ended at a moment after certain time from the start of the washing operation or at a moment after an end of the washing operation. In addition, display corresponding to the reception of the operating information can also be timed after certain time from the reception of the operating information, and is ended after certain time. In this case, display corresponding to the reception of the operating information is ended prior to the start of the washing operation after certain time before the starting key 62 is pressed, and can be ended at a moment under a condition that the starting key 62 is pressed prior to certain time, and can also be displayed continually until certain time passes.

Then, in above embodiments, although the standard process is set through the long pressing operation of the starting key 62, the standard process can also be set through other operations different from the starting operation; for example, within determined time, the standard process is set through an operation that the starting key 62 is only pressed for number of more than two determined times.

Then, in above embodiments, although the starting key 62 is arranged on the body operating part 60, the starting key 62 can also be arranged on the remote controller 100, i.e., the setting operating part. In this case, the setting of the standard process based on the long pressing operation of the starting key 62 is not performed, and processing of steps S105, S112 and S113 are deleted from the main control processing shown in FIG. 10.

Then, in above embodiments, the setting operating part is formed by the remote controller 100. However, the setting operating part is only required to be separated from the body display part DP of the first display part, and can also be arranged on other members different from the upper panel 12, e.g., a front of the machine body part 11, etc.

Then, in above embodiments, the first control part 66, the first storing part 67 and the receiving part 68 are included in the body operating part 60 of the upper panel 12. However, the first control part 66, the first storing part 67 and the receiving part 68 may not necessarily be included in the body operating part 60. For example, the first control part 66, the first storing part 67 and the receiving part 68 can also be arranged on positions other than the upper panel 12 of the body of the full-automatic washing machine 1.

Although the full-automatic washing machine 1 of above embodiments has no drying function performed through a heater, the present disclosure is also suitable for the full-automatic washing machine having the drying function performed through the heater. Then, the present disclosure is suitable for a drum type washing machine.

In addition, various modifications can be properly made to embodiments of the present disclosure within a scope of a technical concept shown in claims.

REFERENCE SIGNS

10 housing;
11 machine body part (part of the housing);
12 upper panel;
14 throwing port;
22 washing and dewatering tank (washing tank);
22*a* opening part;
62 starting key;
DP body display part (first display part);
63 remaining time display part;
65 mode display part;
66 first control part;
68 receiving part;
100 remote controller (setting operating part);
114 magnet;
120 setting key group;
140 information display part (second display part);
150 confirming key;
160 second control part;
170 second storing part (operating information storing part);
180 transmitting part.

What is claimed is:

1. A washing machine, comprising:
a washing tank for performing washing of washings;
a housing for accommodating the washing tank;
a first display part arranged on a surface having a throwing port of the housing;
a first control part;
a receiving part; and
a setting operating part separated from the first display part;
wherein the setting operating part includes: setting keys for setting operating information involved in a washing operation; a second control part; a second display part; and a transmitting part;
the second control part displays the operating information set by the setting keys through the second display part, and transmits the operating information by the transmitting part to the receiving part through wireless communication;
the first control part is configured to execute a washing operation based on the operating information received by the receiving part, and when the operating information is received by the receiving part, to illuminate the first display part in a first form corresponding to the reception of the operating information at least within a specified period until the washing operation starts;
a starting key is arranged on a surface having the throwing port, and is configured to start the washing operation through a first operation applied on the starting key and to set a standard process through a second operation different from the first operation applied on the starting key;
the operating information comprises a plurality of operating processes including the standard process; and
the first control part is configured to: when the second operation is applied on the starting key, set the standard process as an operating process which should be executed by replacing an operating process received by the receiving part prior to the second operation applied on the starting key.

2. The washing machine according to claim 1, wherein
when the standard process is set as the operating process which should be executed based on the second operation applied on the starting key, the first display part is illuminated by the first control part in a second form different from the first form.

3. The washing machine according to claim 2, wherein
the setting operating part is a remote controller;
a magnet is arranged in the remote controller; and
at least a part of the housing is formed by a magnetic body.

4. The washing machine according to claim 2, wherein
the washing tank has an opening part on an upper surface;
the throwing port is formed on the upper surface of the housing;

at least a front opening of the throwing port is larger than the opening part; and the first display part is arranged on a corner of a front side on the upper surface of the housing.

5. The washing machine according to claim 2, wherein the setting operating part comprises: a confirming key and an operating information storing part for storing the operating information; and the second control part stores the operating information transmitted by the transmitting part in the operating information storing part, and the operating information stored in the operating information storing part is read and the read operating information is displayed by the second display part when the confirming key is operated.

6. The washing machine according to claim 5, wherein the setting operating part is a remote controller;

a magnet is arranged in the remote controller; and at least a part of the housing is formed by a magnetic body.

7. The washing machine according to claim 5, wherein the washing tank has an opening part on an upper surface;

the throwing port is formed on the upper surface of the housing;

at least a front opening of the throwing port is larger than the opening part; and the first display part is arranged on a corner of a front side on the upper surface of the housing.

8. The washing machine according to claim 1, wherein the setting operating part comprises: a confirming key and an operating information storing part for storing the operating information; and the second control part stores the operating information transmitted by the transmitting part in the operating information storing part, and the operating information stored in the operating information storing part is read and the read operating information is displayed by the second display part when the confirming key is operated.

9. The washing machine according to claim 8, wherein the setting operating part is a remote controller;

a magnet is arranged in the remote controller; and at least a part of the housing is formed by a magnetic body.

10. The washing machine according to claim 8, wherein the washing tank has an opening part on an upper surface;

the throwing port is formed on the upper surface of the housing;

at least a front opening of the throwing port is larger than the opening part; and the first display part is arranged on a corner of a front side on the upper surface of the housing.

11. The washing machine according to claim 1, wherein the setting operating part is a remote controller;

a magnet is arranged in the remote controller; and at least a part of the housing is formed by a magnetic body.

12. The washing machine according to claim 11, wherein the washing tank has an opening part on an upper surface;

the throwing port is formed on the upper surface of the housing;

at least a front opening of the throwing port is larger than the opening part; and the first display part is arranged on a corner of a front side on the upper surface of the housing.

13. The washing machine according to claim 1, wherein the washing tank has an opening part on an upper surface;

the throwing port is formed on the upper surface of the housing;

at least a front opening of the throwing port is larger than the opening part; and the first display part is arranged on a corner of a front side on the upper surface of the housing.

* * * * *